US006360514B1

(12) United States Patent
Detterman

(10) Patent No.: US 6,360,514 B1
(45) Date of Patent: Mar. 26, 2002

(54) METHOD FOR BULK CARTOONING OF BOOKS

(75) Inventor: Donald E. Detterman, Willard, OH (US)

(73) Assignee: R. R. Donnelley & Sons Company, Chicago, IL (US)

( * ) Notice: Subject to any disclaimer, the term of this patent is extended or adjusted under 35 U.S.C. 154(b) by 0 days.

(21) Appl. No.: 09/716,586

(22) Filed: Nov. 20, 2000

Related U.S. Application Data

(62) Division of application No. 09/173,121, filed on Oct. 15, 1998, now Pat. No. 6,170,231.

(51) Int. Cl.[7] ..... B65B 11/00

(52) U.S. Cl. ..... 53/461; 53/462; 53/556; 493/59; 493/83

(58) Field of Search ..... 53/461, 462, 207, 53/208, 556; 493/59, 82, 80, 83

(56) References Cited

U.S. PATENT DOCUMENTS

| | | | | |
|---|---|---|---|---|
| 1,058,165 A | | 4/1913 | Erickson | |
| 2,837,012 A | | 6/1958 | Burroughs | 93/8 |
| 2,885,842 A | | 5/1959 | Boitel | 53/34 |
| 3,323,275 A | | 6/1967 | Kingsbury et al. | 53/32 |
| 3,374,603 A | * | 3/1968 | Miller et al. | 53/207 |
| 3,478,487 A | | 11/1969 | Smith et al. | 53/66 |
| 3,585,776 A | | 6/1971 | Euwe | 53/32 |
| 3,986,319 A | | 10/1976 | Puskarz et al. | 53/26 |
| 4,449,349 A | | 5/1984 | Roth | 53/66 |
| 4,725,261 A | * | 2/1988 | Millard et al. | 493/82 |

* cited by examiner

*Primary Examiner*—Peter Vo
*Assistant Examiner*—Sam Tawfik
(74) *Attorney, Agent, or Firm*—Fitch, Even, Tabin & Flannery

(57) ABSTRACT

An apparatus and method for forming a carton from a blank sheet of material, in line, and wrapping it about articles of a predetermined size including cutting and scoring blades which are automatically preset according to parameters previously stored, for these particular articles, in a programmable controller.

5 Claims, 6 Drawing Sheets

METHOD FOR BULK CARTOONING OF BOOKS

This is a division, of prior application Ser. No. 09/173,121, filed Oct. 15, 1998, U.S. Pat. No. 6,170,231 which is hereby incorporated herein by reference in its entirety.

BACKGROUND OF THE INVENTION

This invention relates to methods of and apparatus for wrapping books and the like. More particularly, the invention relates to wrap-around packing wherein discrete articles are deposited upon carton blanks which are wrapped about the articles to surround all sides of the articles. The thus obtained packages are then ready for stacking, storage or transport.

In the art of packaging products of variable length, width and height, it s the practice of the manufacturer to maintain a large inventory of pre-scored and pre-slit containers of varying sizes together with an inventory of filler pads for insertion into the filled containers since normal size variations in so-called standard size products will result in the container selected being slightly too small or too large. Thus, a tight package of the product is not obtained without the use of the aforementioned filler pads.

Moreover, when the production is changed to new sized articles to be wrapped, a different sized pre-scored and pre-slit blank must be inventoried and used. This contributes to the initial cost of the packages and necessitates relatively long interruptions of the packing operation during conversion from the processing of a first dimensioned article to the processing of articles of a different second dimension.

SUMMARY OF THE INVENTION

In accordance with the present invention, articles of different sizes such as different pack sizes of books, are wrapped with a carton formed from a blank in a continuous manner in a new and improved process. This is achieved by taking a standard size blank or blanks and custom trimming the blanks to a size relates to the pack size and adjusting the slotting and scoring means to form the blank so that it wraps neatly about the book pack. The preferred process is practiced by an in-line, high speed, case packing machine which can be readily adjusted to handle and carton different sizes of book packs. Preferably information on sizing from previous orders of book packs is stored and used by a controller to reposition slitting knives to cut the blanks to size, to reposition slotting knives to slot the blanks, and/or to reposition slotting blades to score the blanks to neatly fit the carton to the size of the book pack. Thus, the same size of blanks, such as corrugated board blanks, can be customized to the order without having to inventory a large number of blank sizes and/or without having to use filler pads.

This invention provides a machine capable of performing this method in high speed production operation and which will produce a tightly wrapped pack or case that can easily be handled and which is well suited to reduce and to avoid damage to the contents in any such later handing.

In this invention a controller for controlling the sizing, scoring and slotting means has stored information on sizing from previous orders of identical sizes and uses this stored information for automatically adjusting the appropriate scoring blades, trimming knives, etc. in order to produce a pre-sized and pre-formed flat blank which is identical to the said previous orders.

BRIEF DESCRIPTION OF THE DRAWINGS

The drawings show a preferred embodiment of the invention and such embodiment will be described, but it will be understood that various changes may be made from the construction disclosed, and that the drawings and description are not to be construed as defining or limiting the scope of the invention, the claims forming a part of this specification being relied upon for that purpose.

DETAILED DESCRIPTION OF THE PREFERRED EMBODIMENT

Figure 1:
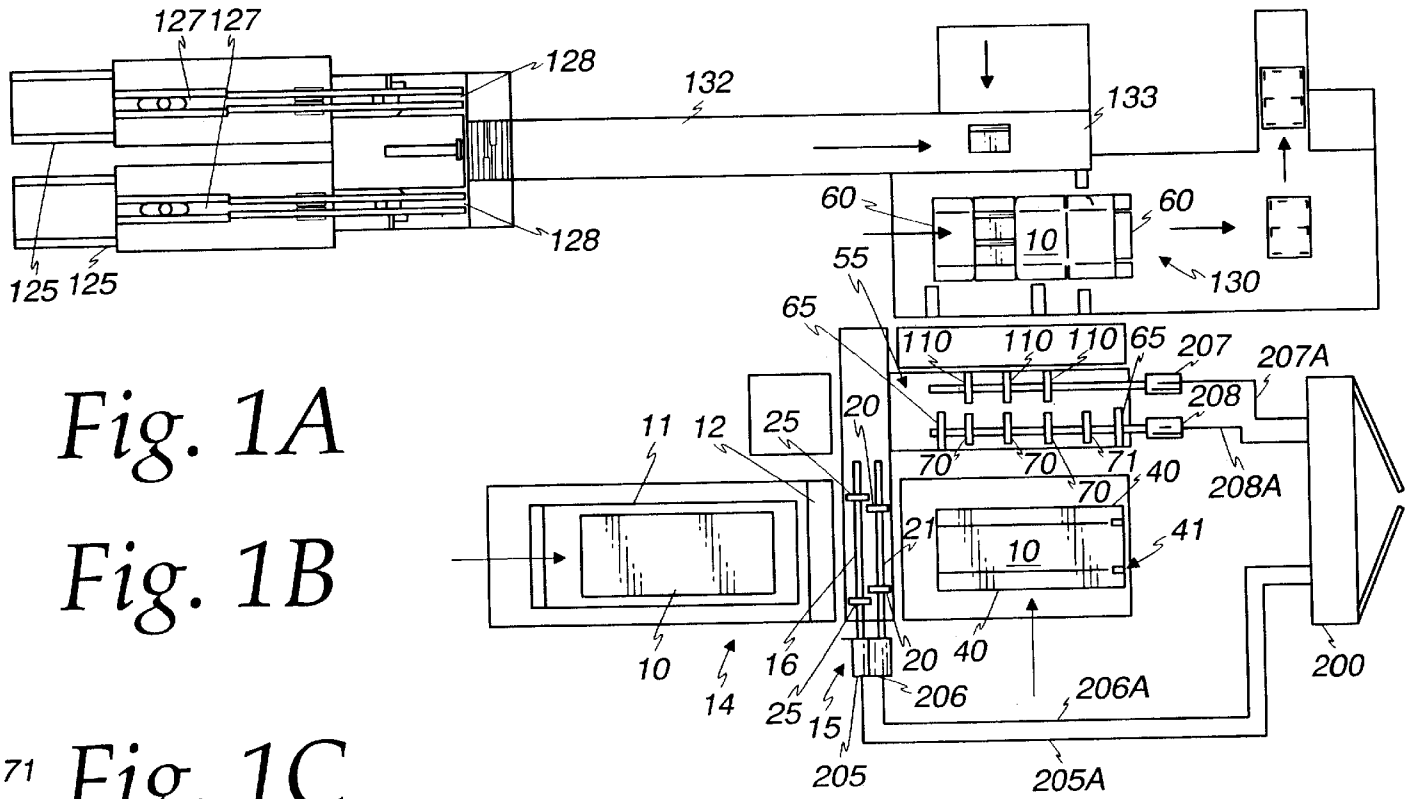
FIG. 1 is a plan view of the system to transport the articles to be packed to the wrapping station and to prepare a properly sized and scored flat blank of wrapping material as shown in FIG. 2.
Figure 2:
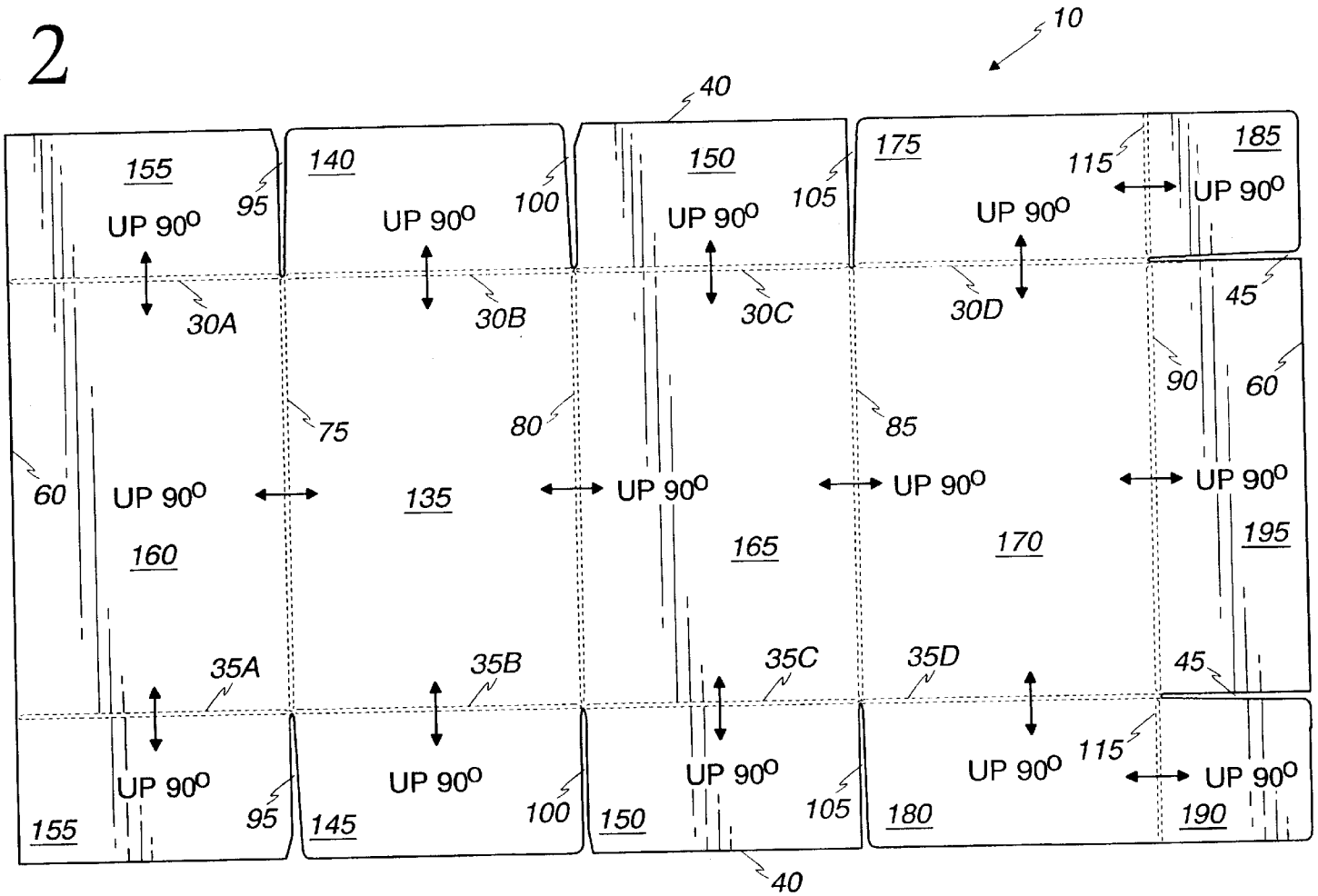
FIG. 2 is a view of a completed pre-scored, trimmed and pre-cut flat blank of wrapping material.

The carton is formed from a single corrugated sheet or blank 10, shown in FIG. 2, by the apparatus shown in FIG. 1.

Flat, corrugated blanks 10 are fed from a stack in a hopper 11 of an up stack sheet feeder 14 by an automatic vacuum blank feed from the top of the stack. The sheet (FIG. 1) is fed by the automatic up stack sheet feeder 14 under the control of a controller 200 in timed relationship onto a conveyor 12 to a first scoring and cutting station 15. Hopper 11 has the capacity for holding enough blanks 10 for a predetermined period of time, e.g. 10 minutes of operation without refilling. A central controller 200 such as a CPU and/or several programmable controllers controls the timed operation of the sheet feeder 14 and conveyors to deliver the standard size blanks 10 for cutting the blank 10 into the appropriate size for the carton needed to pack a particular pack size of books.

The controller 200 has stored therein the various carton sizes for various book packs. The operator of the apparatus identifies the pack size for the books and the controller has stored in memory the size of carton to be cut from the standard size of blanks and the location of the sits to be made in the blank and location of the scores to be made in the blank. Prior to feeding the first blank into a cutting and scoring station 15 where the blank is cut to size and scored, the cutting knives or knife wheels 25 are first positioned to define lateral sides for the trimmed blank. Herein, the knife wheels 25 may be mounted on oppositely threaded portions of a shaft driven by a precisely positioned stepping motor or the like 205. The motor is operated by an electrical line 205*a* connected to the controller 200 to rotate the shaft 16 and cause the blades to move toward or away from one another relative to a center line through the center of the sheet feeder 14 and the blanks 10 being fed thereby so that equal amounts will be cut from opposite sides of the blank. If desired, each cutting blade 25 could have separate motor and a separate positioning shaft so that the knives could be moved independently and through respectively different distances.

The controller 200 will in a like manner position scoring wheels 20 mounted on a common shaft 21 having oppositely threaded ends with the shaft 21 being driven by a stepper motor 206 or the like which is connected over and electrical control line 206*a* to the controller 200. Thus, the scoring wheels 20 are adjusted to the positions needed to provide the scoring line locations for the particular carton to be erected for a given pack size of books. The location of the score lines may vary one pack size of books to the next pack size of books.

Prior to feeding the first blank 10, second edge trimmer knife wheels 65 and second scoring wheels 70 at a second cutting station 55 are positioned by reversible motors in a manner similar to that described above for the knife wheels 25 and scoring wheels 20.

The location of the cutting and scoring blades in the first station 15 have been predetermined by the programmable controller in the electrical cabinet 200, and placed in these locations by reversible motors 205 and 206. The leading edge of a single corrugated sheet 10 is conveyed from the up stacker sheet feeder 12 to the right in the longitudinal direction of the sheet 10 in FIG. 1 through the first scoring and cutting station 15 by a positive feed assembly that either grips and pulls the sheet 10 or pushes the sheet 10 as near as possible to the outside edges. The first scoring wheels 20 will form the first and second score lines 30 and 35, respectively, as well as the lid flap cuts 45 (FIG. 2) on the corrugated sheet 10. Rotatable, first edge-trimming knife wheels 25, are capable of trimming the outside horizontal longitudinally extending edges 40 of the corrugated sheet 10 by up to 3 inches. Scrap trimmed from the longitudinally extending edges 40 will be dropped into and accumulated in a hopper which is at a lower level and which is equipped for rolling out of the machine for dumping by an individual fork lift. The scrap may also be accumulated in a remote area by means of a vacuum system (not shown).

Figure 1A:
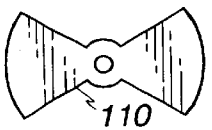
FIG. 1A shows one possible configuration for the second rotatable cutting wheels of the second cutting and scoring station.
Figure 1B:
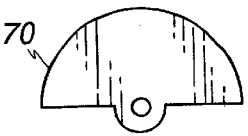
FIG 1B shows one possible configuration for the second rotating scoring wheels of the second cutting and scoring station.
Figure 1C:
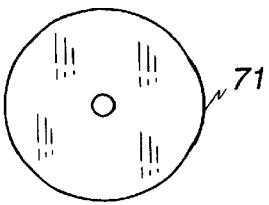
FIG. 1C shows the third rotating scoring wheel for the second scoring station.

The corrugated sheet 10 is then fed at right angles from the cross feed station 41 to a second cutting station 55 for the short dimension scoring and slitting operations. The location of the cutting and scoring blades 70 and 110 in this station 55 have also been predetermined by a programmable controller in the electrical cabinet 200, and placed in these locations by reversible motors 207 and 208. At this second cutting station 55, rotatable, second edge-trimming knife wheels 65 sever the corrugated sheet 10 at the outside vertical edges 60 to trim the sheet to size. Also, second rotating scoring wheels 70 (FIG. 1B), will make the third, fourth, and fifth score lines 75, 80, and 85, respectively, while the third rotating scoring wheel 71 (FIG. 1C), accomplishes the scoring of the sixth score line 90 which includes the scoring of the seventh score lines 115 at first and second top inside end flaps 185 and 190 respectively in the corrugated sheet 10. Second rotatable cutting wheels 110 (FIG. 1A) sever the sheet to make first and second side-bottom cuts 95 and 100, respectively, and side-toe cut 105, in the corrugated sheet 10. The sheet 10 is fed into the wrap-around station 130 to await the arrival of a stack of articles.

Individual articles 120 are fed to the cartoning machine (FIG. 1) by a continuous conveyor 125, the articles 120, are then turned and stacked by turner, stacker 127, delivered by the stack, delivery 128, and moved on to the transfer, loader 133, by the infeed, indexing 132. The transfer, loader 133, is preferably an air lift transfer table which feeds the stack of individual articles over the top of a scored and cut flat corrugated sheet 10, in the wrap-around station 130.

Figure 3:
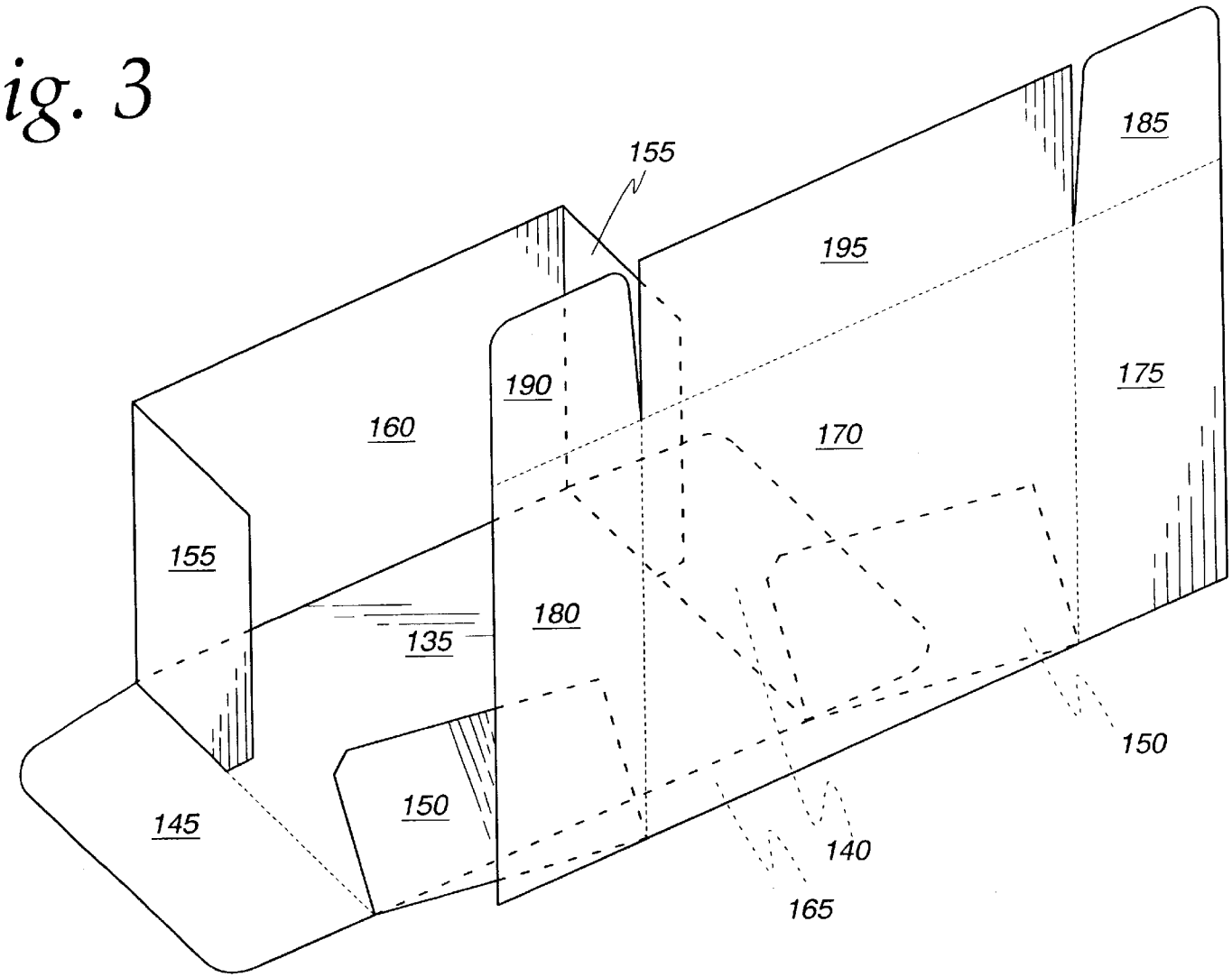
FIG. 3 shows the pre-cut blank wrapping material of FIG. 2 in a first position about material to be wrapped (not shown).
Figure 4:
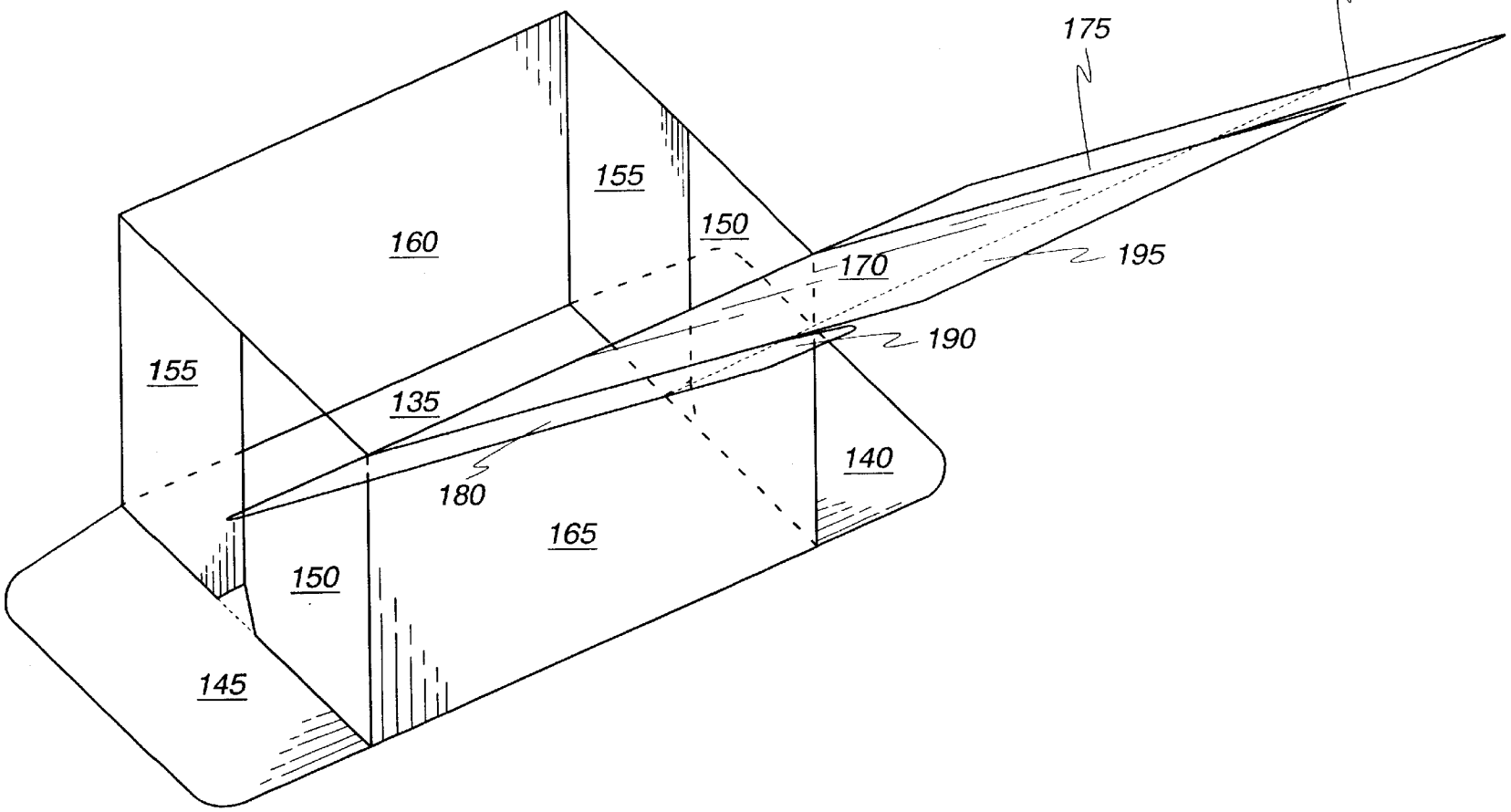
FIG. 4 shows the continued wrapping process with all four sides enclosed.
Figure 5:
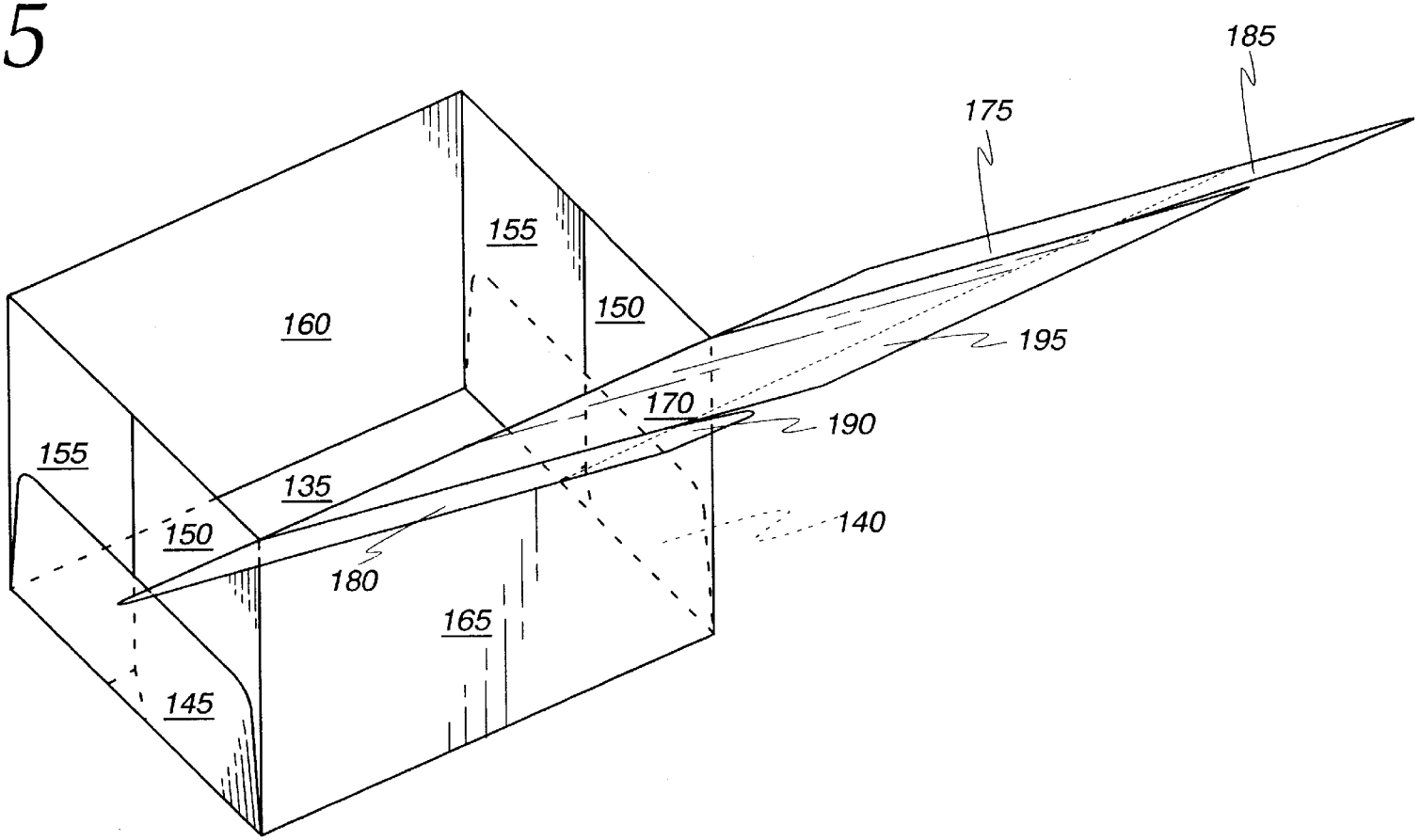
FIG. 5 shows continued wrapping process with bottom side flaps in final position.

At the wrap-around station 130, the stacks of individual articles 120, are seated on the bottom panel 135, and the stacks and sheet are pushed downward forcing the carton blank through former guides to turn up end and side flaps. A table supports the carton blank and the stack as they move downward. Therefore, as the stacks and carton blank are pushed down, first and second side flaps 160 and 165 (FIG. 3) are bent up about third and fourth score lines 75 and 80, respectively, to position the first and second side flaps 160 and 165 alone the sides of the stack's outer side. Also, first side and second side inside end flaps 150 and 155 (FIG. 4) are plowed to fold along first and second score lines 30*a*, 35*a*, 30*c*, and 35*c*; and first and second bottom end flaps 140 and 145 (FIG. 5) are bent about first and second score lines 30*b*, and 35*b* to cover the first and second side inside end flaps 150 and 155. Thus, the stacks of individual articles 120, are covered on the bottom and the four vertical sides.

Figure 6:
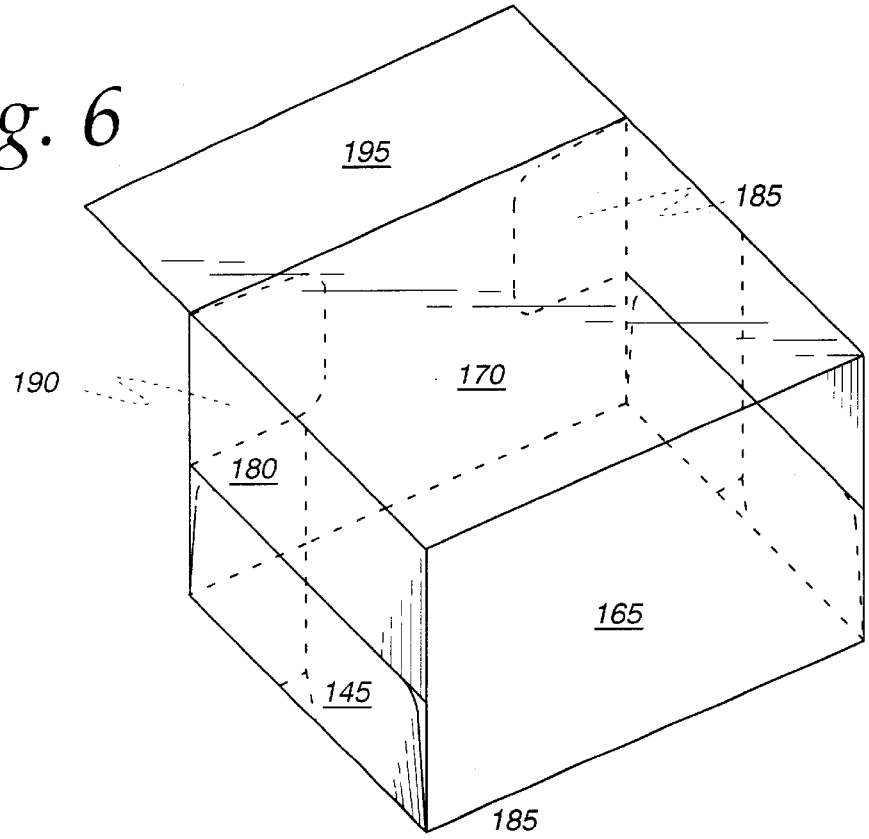
FIG. 6 shows continued wrapping process with top cover in place.
Figure 7:
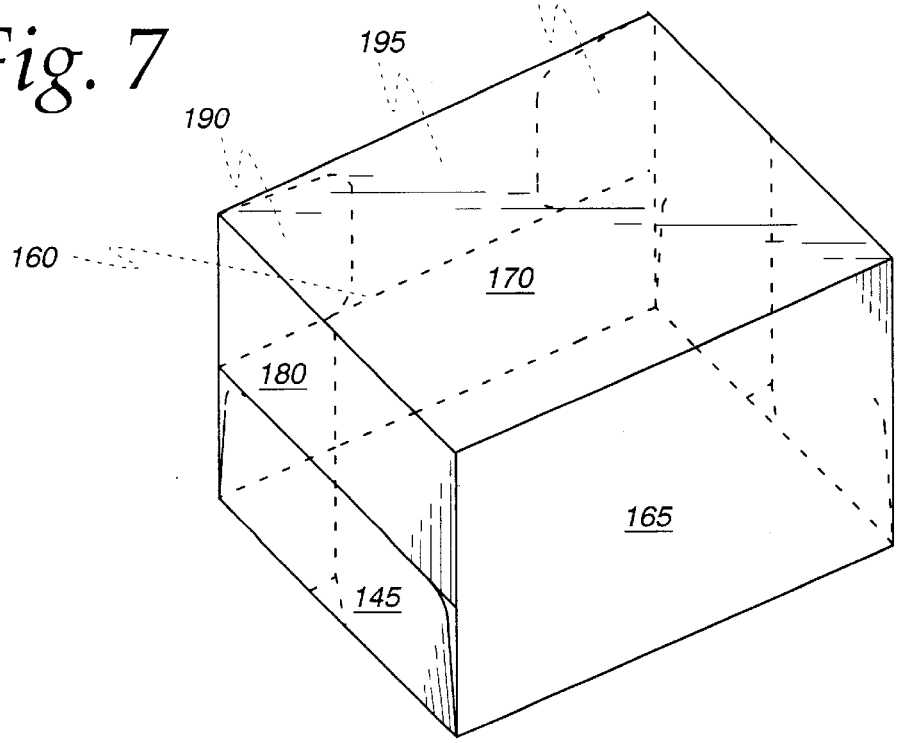
FIG. 7 shows final wrapping with formed lid for opening carton and prior to gluing, labeling and taping.

Next, the stacks of individual articles 120, and the corrugated sheet 10 are fed horizontally to a former station where a top panel 170 (FIG. 6) is bent at fifth score line 85 over the top of the stacks of books 120; and first and second top outside end flaps 175 and 180 are plowed down about first and second score lines 30*d* and 35*d*. At the next station, the first and second top inside end flaps 185 and 190 (FIG. 7) are folded at seventh score lines 115 across the first side panel 160. A top primary flap 195 connected to the top panel 170 at sixth score line 90 is folded down, which is glued to first and second top inside end flaps 185 and 190 to form the lid by which the carton may be opened.

The incoming corrugated sheets 10 and the stacks of individual articles 120, continuously travel through the cartoning station without stopping. The cartoning machine can accept a stream of 100 books per minute with surges up to 105 BPM and is capable of delivering sealed cartons containing from 8 to 30 books without delaying or causing slowdowns in the incoming product stream. The carton may also be kept compressed, and tape may be wrapped about the carton instead of, or, in addition to, the aforementioned gluing process.

While specific details of a preferred embodiment have been set forth above, it will be apparent that many changes and modifications may be made therein without departing from the spirit of the invention. It will therefore be understood that what has been described herein is intended to be illustrative only and is not intended to limit the scope of the invention.

What is claimed is:

1. A method for forming cartons of sizes adjusted to an article of predetermined size to be cartoned therein, said method comprising of:

operating a controller and repositioning, sizing and cutting knives to trim one or more longitudinal and transverse side edges to provide a custom trimmed blank which is smaller than the predetermined size of blank in at least one of the blank's overall width and length between the trimmed side edges and which is trimmed across the entire width and length of the edge;

shifting scoring devices to positions for scoring the blank to provide a wrap-around carton with a plurality of panels including a bottom panel which is adjusted in size to be customized to the size and shape of the articles being wrapped;

cutting at least one edge across the entire width or length of the edge with the repositioned sizing and cutting knives to provide a trimmed blank which is smaller in overall width or length between edges of the blank;

scoring the blank with the shifted scoring devices to form a bottom panel which is adjusted in size to the size of a bottom side of the article and other panels customized to the size and shape of the article being wrapped to form a trimmed blank sized for the size of the article;

feeding articles of a predetermined size to a wrap-around station to have the trimmed blank wrapped thereabout;

feeding the trimmed blank into the wrap-around station;

wrapping the articles with the trimmed blank to form a carton sized to the article; and discharging the cartoned article from the wrap-around station.

2. The method of claim 1 wherein the operating and positioning step includes driving a plurality of cutting, scoring and trimming knives to locations selected for the carton.

3. A method in accordance with claim 1 comprising:

stacking and dispensing blanks from a stack for being stored and trimmed; and feeding a stack of books as the article to be cartoned.

4. A method in accordance with claim 1 comprising:

feeding the blanks along a first path and along a first side of the wrap around station; and feeding the articles along a path parallel to the first path and along an opposite second side from the first side of the wrap around station with the wrap around station being between the first and second paths.

5. A method in accordance with claim 1 comprising:

traveling the blank in a first direction when cutting at least one edge across the length or width of an edge of the blank to reduce the size of the blank; and traveling the blank in a direction transferse to the first direction when scoring the blank.

* * * * *

UNITED STATES PATENT AND TRADEMARK OFFICE

CERTIFICATE OF CORRECTION

PATENT NO. : 6,360,514 B1 
DATED : March 26, 2002
INVENTOR(S) : Donald E. Detterman It is certified that error appears in the above-identified patent and that said Letters Patent is hereby corrected as shown below:

Title page,
Change "Cartooning" to -- Cartoning --.

Column 6,
Line 16, change "transferse" to -- transverse --

Signed and Sealed this

Second Day of July, 2002

*Attest:*

*Attesting Officer*

JAMES E. ROGAN
*Director of the United States Patent and Trademark Office*